United States Patent [19]

Schold

[11] Patent Number: 4,854,720

[45] Date of Patent: Aug. 8, 1989

[54] DISPERSER APPARATUS WITH TWO COAXIAL DRIVE SHAFTS

[76] Inventor: George R. Schold, 8460 Macoma Dr., NE., St. Petersburg, Fla. 33702

[21] Appl. No.: 514,322

[22] Filed: Jul. 15, 1983

[51] Int. Cl.[4] ..... B01F 7/20; B01F 7/26

[52] U.S. Cl. ..... 366/294; 366/295; 366/313; 366/317

[58] Field of Search ..... 366/262–265, 366/279, 293–296, 309, 312, 313, 315, 316, 317, 329; 384/135; 415/142, 170 B, 173 A, 501; 416/85, 174, 231 A, 244 B, 246, 500

[56] References Cited

U.S. PATENT DOCUMENTS

| | | | |
|---|---|---|---|
| 92 | 1/1876 | Cowles | 366/296 |
| 2,209,287 | 7/1940 | Simpson | 366/294 |
| 2,823,868 | 2/1958 | Scherer | 366/315 |
| 2,876,082 | 3/1959 | Morrison | 366/296 |
| 2,928,665 | 3/1960 | Epprecht | 366/264 |
| 4,190,371 | 2/1980 | Durr | 366/294 |
| 4,197,019 | 4/1980 | Schold | 366/294 |
| 4,403,868 | 9/1983 | Kupka | 366/295 |

*Primary Examiner*—Harvey C. Hornsby
*Assistant Examiner*—Scott J. Haugland
*Attorney, Agent, or Firm*—Frank R. Thienpont

[57] ABSTRACT

A mixing machine for dispersing finely divided solid particles in a liquid vehicle including a pair of coaxially extending shafts, one shaft being longer than the other, an impeller disposed at the end of the longer shaft, and an impeller assembly connected to the shorter shaft, the impeller disposed on the longer shaft being a high speed impeller and the impeller assembly connected to the shorter shaft being a low speed impeller assembly. The low speed impeller assembly is constructed with a plurality of laterally extending arms attached to the shorter shaft and a plurality of vertically extending rods connected to the outer ends of laterally extending arms. The rods in turn each carry one of the blades or vanes of the low speed impeller. This construction allows the bearing and seal arrangement disposed between the low and high speed shafts to be at a point along the shafts where it will be substantially out of contact with product being processed.

7 Claims, 2 Drawing Sheets

Fig. 4.
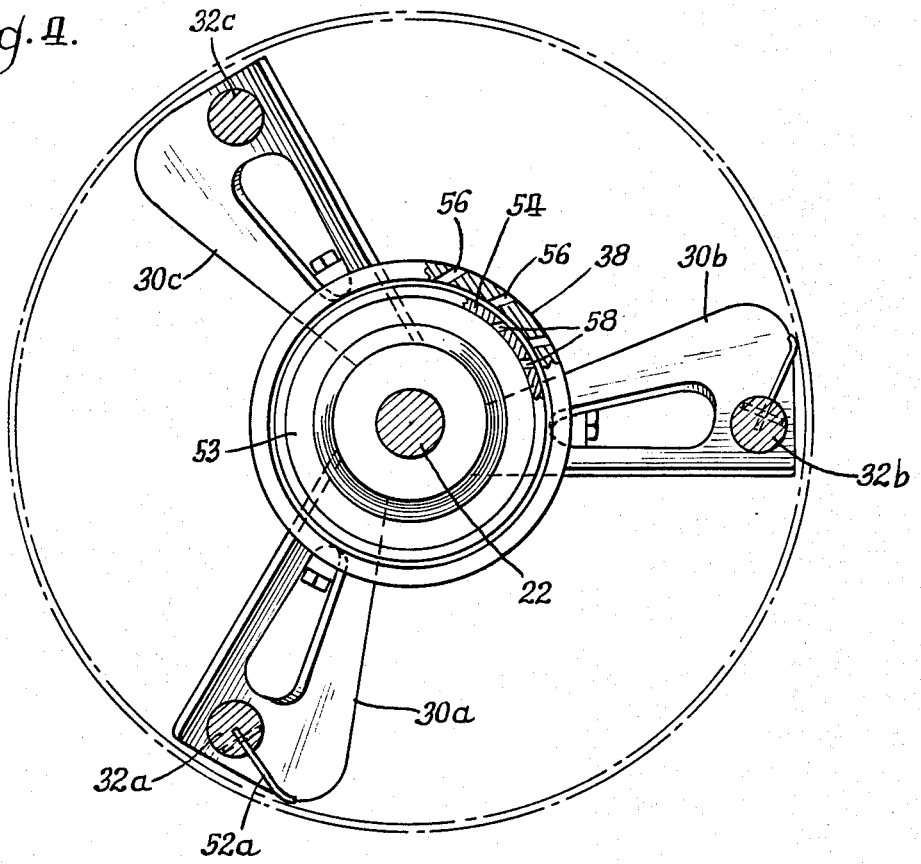
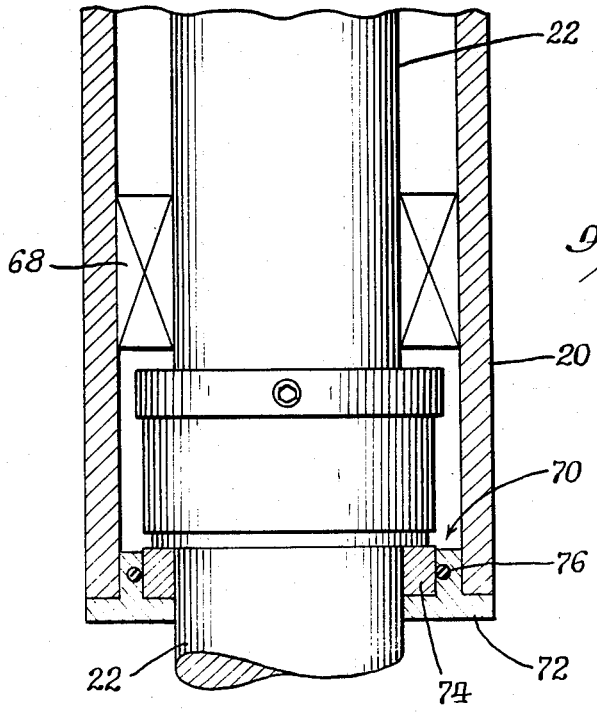
Fig. 5.

DISPERSER APPARATUS WITH TWO COAXIAL DRIVE SHAFTS

BACKGROUND OF THE INVENTION

This invention relates to dispersing machines for dispersing solid particles in a liquid vehicle.

A machine of this general type is disclosed, for example, in U.S. Pat. No. 4,197,019 issued Apr. 8, 1980.

SUMMARY OF THE INVENTION

An object of the present invention is to provide in a dispersing apparatus of the type herein described a pair of coaxially disposed agitator impellers carried by a pair of coaxially disposed impeller shafts and wherein the bearing and seal assembly between the low and high speed impeller shafts is disposed at the upper portion of the shaft assembly so as to be substantially out of contact with product being mixed by the dispersing apparatus.

Another object is to provide improved mixing means by providing in association with the low speed impeller assembly means for removing product from the container walls which tend to cling to walls as the mixture is being processed.

Other objects and advantages of this invention will become more apparent from reading the following description in connection with the accompanying drawings.

BRIEF DESCRIPTION OF THE DRAWINGS

FIG. 4 is a plan view of the low and high speed impellers taken along line 4—4 of FIG. 2;

FIG. 5 is an enlarged view in elevation and partially in section of the bearing and seal arrangement between the low and high speed impeller shafts.

DESCRIPTION OF THE PREFERRED EMBODIMENT

Figure 1:
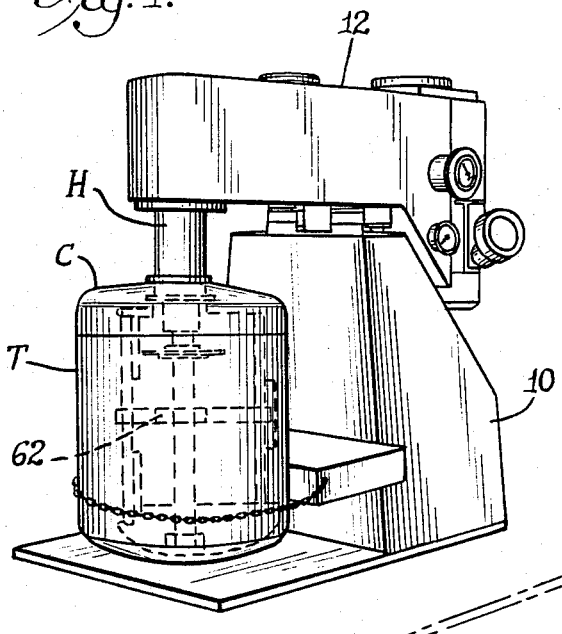
FIG. 1 is a perspective view of a dispersing apparatus embodying the invention herein.
Figure 2:
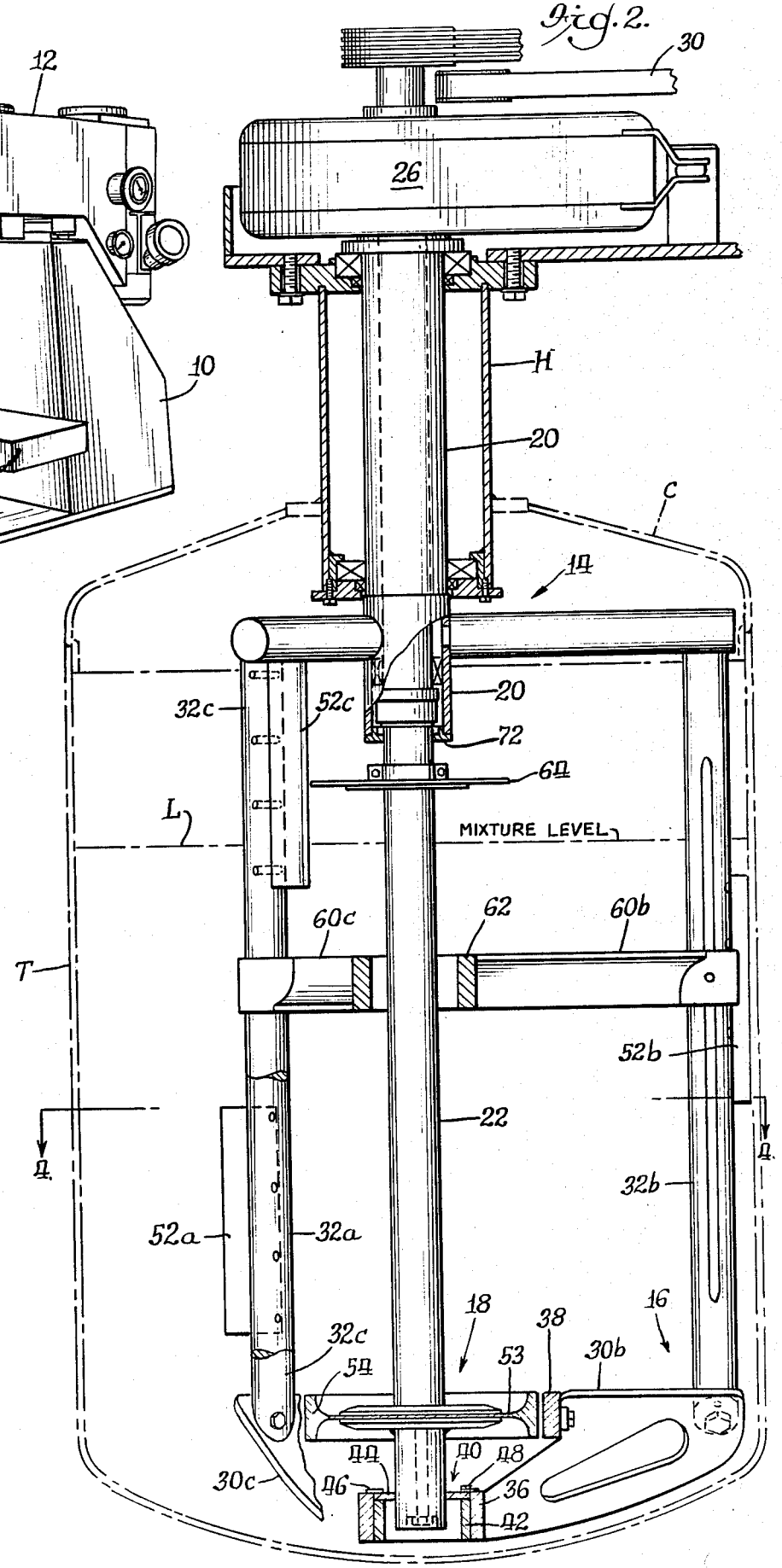
FIG. 2 is a view in elevation, and partially in section, showing the low speed and high speed impeller assembly in a working position in a mixing vessel.

Referring now to the drawings, FIGS. 1 and 2 show the overall dispersing apparatus including a base or mounting frame 10, a motor drive assembly 12, and an agitator drive shaft assembly 14 which includes a low speed impeller assembly or agitator assembly 16 and a high speed impeller or agitator 18 attached to the drive shaft assembly 14. A mixing tank in which material processing takes place is designated as T.

The tank T as shown here is an enclosed tank with a cover C which is attached to a tubular portion H which surrounds, and houses in part, the upper portion of the agitator drive shaft assembly 14. The drive shaft assembly may be raised and lowered hydraulically carrying with it the cover C. An open tank can also be used as referred to in U.S. Pat. No. 4,197,019.

The motor drive assembly 12 may be of the type described in U.S. Pat. No. 4,197,019 and may include a variable speed motor for driving a low speed agitator shaft 20 and a second variable speed motor for driving a high speed agitator shaft 22. The high speed agitator shaft 22 is mounted coaxially with and extends through the low speed agitator shaft 20 as clearly seen in FIG. 2.

The drive shaft assembly 14 comprises an inner high speed agitator shaft 22 and an outer low speed agitator shaft 20. The high speed shaft 22 is disposed coaxially within and extends through the low speed shaft 20 and is connected to and drives the high speed impeller 18. The low speed shaft 20 is a short tubular unit which is connected to and drives the low speed impeller assembly 16.

A first belt and pulley drive arrangement 24 interconnects a variable speed motor (not shown) and the low speed agitator shaft 20 through a speed reducer 26. A second belt and pulley arrangement 28 interconnects another motor (not shown) and the high speed agitator shaft 22. A similar drive arrangement is shown in U.S. Pat. No. 4,197,019.

Figure 3:
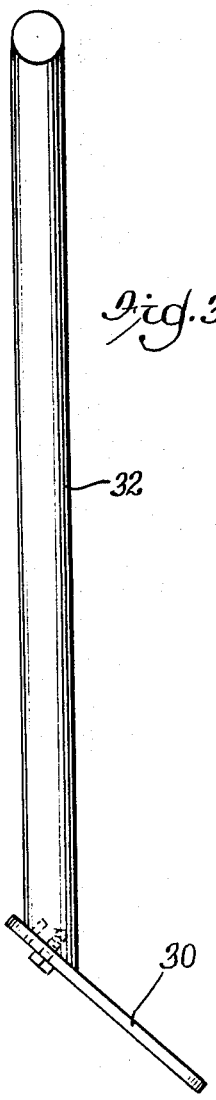
FIG. 3 is a view in elevation of one of the vertically extending rods of the low speed impeller assembly with an attached impeller blade.

The low speed impeller assembly 16 comprises three equiangularly spaced impeller blades 30*a*, 30*b* and 30*c* which are attached respectively to the lower ends of vertically extending rods 32*a*, 32*b* and 32*c*. These rods in turn are attached to the outer ends of radially extending arms 34*a*, 34*b* and 34*c* which are connected to and extend from the low speed shaft 20. Rotation of the shaft 20 obviously rotates the entirellow speed impeller assembly. Each of the low speed impeller blades 30*a*, 30*b* and 30*c* comprise a blade-like structure as seen in FIGS. 2, 3 and 4. The radially inner ends of the blades 30*a*, 30*b* and 30*c* are attached to a centrally disposed collar or hub 36 which surrounds the lower end of shaft 22. An annular ring member 38 may be attached to the three impeller blades by bolts or other suitable means at a point substantially interxediate the length of the blades and at the upper edge thereof as seen in FIGS. 2 and 4. The ring member 38 is designed to cooperate with an adjacently disposed ring member formed on the high speed impeller to be described below. The ring member 38 preferably is about $1\frac{1}{4}''$–$1\frac{1}{2}''$ in height.

The high speed shaft 22 may tend to vibrate an abnormal amount at certain speeds depending sometimes on the type of material being processed. To take care of this eventuality a centering device 40 may be used. Its purpose is to snub or inhibit excessive vibrations of the high speed shaft. The centering device 40 comprises in part the collar or hub 36 and further includes a concentrically disposed ring member 42. A teflon ring 44 surrounds shaft 22 and may be secured to the upper end of ring member 42 by a securing ring 46 and plurality of bolts 48. During operation the teflon ring inhibits the vibrations of the end of the shaft 22 as it snugly surrounds the lower end of the shaft 22.

Scraper blades 52*a*, 52*b* and 52*c* are attached respectively to rods 32*a*, 32*b* and 32*c*. During operation these scraper blades are in contact with or are closely positioned to the container wall and serves to prevent a build-up of product being processed on the container wall by scraping the wall clean. Preferably a relatively short scraper blade is placed on each rod rather than one long blade being attached to a single rod so as to achieve a better balance of forces on the low speed impeller assembly. The three relatively short scraper blades as best shown in FIG. 2 preferably are placed at different vertical positions on the rods 32*a*, 32*b*, 32*c* to cover a maximum amount of vertical height on the container wall.

The high speed impeller 18 may be a flat, annular blade 53 having attached to the outer edge thereof a ring member 54 which is of smaller diameter than ring member 38. In the assembly, ring members 38 and 54 are spaced apart a predetermined distance preferably in the range of 1/16"-⅜". In operation the rotation of the ring members 38 and 54 at different speeds relative to each other (sometimes on the order of 20-1) produces a shearing effect on the particles in the mixture being processed.

Each of the ring members 38 and 54 may have formed therein respectively a plurality of slots 56 and 58 which further assist the agitation and shearing effect on the particles in the material being processed.

For additional agitation effect in the mixture being processed a plurality of radially extending arms 60*a*, 60*b* and 60*c* may be attached at one end to the rods 32*a*, 32*b* and 32*c* respectively and at the other to a collar or hub 62 which surrounds shaft 22. The vertical position of these arms 60*a*, 60*b* and 60*c* is adjustable to higher and lower positions on the rods 30*a*, 30*b* and 30*c*, means being provided to adjustably secure the ends of the arms to the rods.

An annular baffle plate 64 is attached to the upper end of the high speed shaft 22 at a point above the normal full position of the mixture being processed shown as level L. This baffle plate 64 is intended to prevent mixture from moving up the shaft 22 and into the bearing and seal arrangement 66 located just above the baffle plate.

Certain products which are processed in this type of equipment attack the seal if the seal is fully, or to a large extent, submerged in the product being processed. This is especially true with certain glues, resins, strong solvents or epoxies. Accordingly, the bearing and seal arrangement 66 is disposed well above the normal level of the mixture when the tank is full so as to avoid substantial contact between the seal and the product being processed.

The bearing and seal arrangement 66 disposed between the low speed shaft 20 and high speed shaft 22 includes a bearing 68 and a seal assembly 70 and is disposed in the lower end of low speed shaft 20. An annular cup-like ring member 72 fits into the bottom end of the tubular low speed drive shaft 20 and surrounds the high speed shaft 22. The ring member 72 may support a teflon bearing 74 and seal 76 disposed in the sidewall of the cup-like ring member.

While certain perferred embodiments of the invention have been disclosed, it will be appreciated that these are shown by way of example only, and the invention is not to be limited thereto as other variations will be apparent to those skilled in the art and the invention is to be given its fullest possible interpretation within the terms of the following claims.

What is claimed is:

1. Apparatus for dispersing solid particles carried in suspension in a liquid vehicle comprising:

a motor driven assembly for driving a pair of coaxially disposed drive shafts;

a mounting frame for carrying said motor drive assembly;

a pair of coaxially disposed impeller drive shafts of unequal length connected to be driven by said motor drive assembly;

low speed impeller means including a plurality of impeller blades connected to and driven by the shorter of said drive shafts;

high speed impeller means connected to and driven by the longer of said drive shafts;

means connecting said low speed impeller means to the shorter of said drive shafts including a plurality of laterally extending arms connected to said shorter drive shaft;

a substantially vertically extending rod attached at the outer end of each of said laterally extending arms;

a central hub surrounding the longer of said drive shafts and disposed at the lower end thereof;

each low speed impeller blade being connected at its radial outer end to the lower end of one of said vertically extending rods and at its radial inner end to said central hub;

said high speed impeller means including a continuously extending first ring member formed on the outer periphery of said impeller means;

said low speed impeller means including a continuously extending second ring member attached thereto and spaced radially inwardly from the outer periphery of said impeller blades; and said ring members being spaced a relatively small distance from each other;

2. The apparatus of claim 1 including means defining a plurality of openings extending through at least one of said ring members for increasing the particle shearing effect of said ring member.

3. The apparatus of claim 1 wherein the distance between said first and second ring members is in the range of 1/32" to ⅜".

4. Apparatus for dispersing solid particles carried in suspension in a liquid vehicle comprising:

a motor drive assembly for driving a pair of coaxially disposed drive shafts;

a mounting frame for carrying said motor drive assembly;

a pair of coaxially disposed impeller drive shafts of unequal length connected to be driven by said motor drive assembly;

low speed impeller means including a plurality of impeller blades connected to and driven by the shorter of said drive shafts;

high speed impeller means connected to and driven by the longer of said drive shafts;

means connecting said low speed impeller means to the shorter of said drive shafts including as plurality of laterally extending arms connected to said shorter drive shaft;

a substantially vertically extending rod attached at the outer end of each of said laterally extending arms;

a central hub surrounding the longer of said drive shafts and disposed at the lower end thereof;

each low speed impeller blade being connected at its radial outer end to the lower end of one of said vertically extending rods and at its radial inner end to said central hub; and a plurality of horizontally extending agitator arms attached at one end to said vertically extending rods and at the other end to a hub member surrounding the longer of said drive shafts.

5. The apparatus of claim 4 wherein said horizontally extending agitator arms are adjustably connected to said vertically extending arms to allow selective vertical placement of said agitator arms in said apparatus.

6. Apparatus for dispersing solid particles carried in suspension in a liquid vehicle comprising;

a motor drive assembly for driving a pair of co-axially disposed drive shafts;

a mounting frame for carrying said motor drive assembly;

a pair of coaxially disposed impeller drive shafts of unequal length connected to be driven by said motor drive assembly;

low speed impeller means including a plurality of impeller blades connected to and driven by the shorter of said drive shafts;

a pair of coaxially disposed impeller drive shafts of unequal length connected to be driven by said motor drive assembly;

low speed impeller means including a plurality of impeller blades connected to and driven by the shorter of said drive shafts;

high speed impeller means connected to and driven by the longer of said drive shafts;

means connecting said low speed impeller means to the shorter of said drive shafts including a plurality of laterally extending arms connected to said shorter drive shaft;

a substantially vertically extending rod attached at the outer end of each of said laterally extending arms;

a central hub surrounding the longer of said drive shafts and disposed at the lower end thereof;

each low speed impeller blade being connected at its radial outer end to the lower end of one of said vertically extending rods and at its radial inner end to said central hub;

a bearing and seal arrangement disposed between said low and high speed drive shafts at a point along said shafts which will be above and out of substantial contact with the product being processed, and radially extending baffle means connected to the upper end of said high speed impeller drive shaft and closely adjacent and below speed impeller drive shaft and closely adjacent and below said bearing and seal arrangement.

7. Apparatus for dispersing solid particles carried in suspension in a liquid vehicle comprising:

a motor drive assembly for driving a pair of coaxially disposed drive shafts;

a mounting frame for carrying said motor drive assembly;

high speed impeller means connected to and driven by the longer of said drive shafts;

means connecting said low speed impeller means to the shorter of said drive shafts including a plurality of laterally extending arms connected to said shorter drive shaft;

a substantially vertically extending rod attached at the outer end of each of said laterally extending arms;

a central hub surrounding the longer of said drive shafts and disposed at the lower end thereof;

each low speed impeller blade being connected at its radial outer end to the lower end of one of said vertically extending rods and at its radial inner end to said central hub;

a bearing and seal arrangement disposed between said low and high speed drive shafts at a point along said shafts which will be above the normal level of product being processed in an associated tank when the tank is full; and radially extending baffle means connected to the upper end of said high speed impeller drive shaft for protecting a bearing and seal arrangement disposed between said low and high speed drive shafts from product being processed.

* * * * *